United States Patent [19]

Ab

[11] 4,325,005

[45] Apr. 13, 1982

[54] ION ACCELERATOR AND A METHOD FOR INCREASING ITS EFFICIENCY

[76] Inventor: Emil A. Ab, 1Emil Ab, 16/3 Ramot, Jerusalem, Israel

[21] Appl. No.: 57,894

[22] Filed: Jul. 16, 1979

[51] Int. Cl.[3] ..... H01J 27/02

[52] U.S. Cl. ..... 315/111.81; 250/427; 313/230; 313/363.1; 376/109

[58] Field of Search ..... 315/111, 111.8, 111.9; 250/423 R, 427; 313/230, 231, 363; 328/227

[56] References Cited

U.S. PATENT DOCUMENTS 3,448,315 6/1969 Hirsch et al. ..... 315/111.9 X 4,135,094 1/1979 Hull ..... 250/427

4,157,471 6/1979 Mlekodaj ..... 250/423 R

*Primary Examiner*—Eugene R. La Roche

[57] ABSTRACT

The ion accelerator comprises an arrangement consisting of getter pumps and gas storages. This makes for a possibility of gas pressure and gas phase composition control in the device after its being unsoldered from the vacuum installation. The device is equipped with an evaporator and an additional gas storage which permit renovating the target surface as required. Proposed herein is a method ensuring higher efficiency of the device operation.

25 Claims, 5 Drawing Figures

ION ACCELERATOR AND A METHOD FOR INCREASING ITS EFFICIENCY

BACKGROUND OF THE INVENTION

This invention relates to the field of particle accelerators or, more particularly, to the field of ion accelerators. These devices are used in nuclear physics, in various methods of analysis in geological prospecting, in geophysics, and in radiation chemistry.

Ion accelerators are well-known tools for ion bombardment used in physics and technology. The use of such devices in industry places on them the demands of portability and transportability. Devices developed in accordance with these demands contain an ion source, accelerating electrodes, and a target unit.

In order to make the device operative it is subjected to vacuum treatment. After the device has been unsoldered from the vacuum installation where evacuation was performed from its cavity, the pressure inside the device does not stay constant, for internal surfaces of the device give off residual gases which are impossible to remove completely in the course of vacuum treatment. Furthermore, a portion of the working gas (i.e. the gas whose ions are accelerated in the device) is absorbed in the target and other components of the accelerator.

Included in known devices, therefore, is a pressure control unit. It is constructed as a conductor which is placed in the accelerator cavity and has leads passing to the outside. In the course of vacuum treatment a portion of the conductor placed in the accelerator cavity is saturated with gas. As required, the gas is expelled from the conductor by heating the latter with electric current. The absorption of the liberated gas takes place during conductor cooling after the electric current has been switched off. In practice, however, the gas evolved in the course of heating is not absorbed completely, so that gas pressure control can be effected within a limited range of magnituide. It is impossible to control gas phase composition inside the device.

It should be added that in the course of evacuation particles of oils and other materials penetrate inside the device from the pumps and faucets of the vacuum installation to be subsequently accumulated on the target surface. Upon accleration, the ions of foreign gases reach the target and in doing so form a parasitic constituent of the ion current to the target. All this results in lowered accelerator efficiency.

Foreign gases penetrating the cavity of the device bring about changes in ionization conditions, i.e. reduce the total amount of ions of the working (ionized) gas by lowering the amount of atomic ions most effective in target bombardment.

As a result, certain characteristics of unsoldered accelerators are substantially lower than those for stationary devices. For example, under optimal conditions realizable in stationary deuton accelerators which bombard tritium targets for neutron production, up to $10^8$ neutron/sec are produced at 150 kV and a 1 MA current, whereas in portable unsoldered accelerators the rate is by almost two orders of magnitude below this figure constituting about $10^6$ neutrons/sec at the same feed parameters.

The above traces of vacuum oil and cement vapors are sorbed on the surfaces of accelerator components, these materials decomposing on the target under the influence of ion bombardment. Thus the cracking process takes place. Heavy hydrocarbons and carbon formed can no longer desorb from the surface, which leads to the development of an inert layer ever increasing in the course of time, and in this layer the accelerated ions bombarding the target lose their energy with no other effect than heating the target. In stationary accelerators the contaminated target is replaced, and the service life of the device is practically limitless. In an unsoldered accelerator, target contamination and the reduction of tritium concentration which take place in the course of operation limit the service life to 100–150 hours.

And, lastly, the dimensions of the ion source of a portable accelertor are limited, and this results in somewhat over-high pressure under which the source operates, since otherwise a sufficient quantity of ions cannot be obtained in a given volume. The increase in pressure, however, reduces the percentage of the more effective atomic ions and impairs conditions for ion acceleration in the acceleration gas where the pressure is the same as in the ion source.

In order to overcome the ageing of the target and to preclude the failure of the entire device, an arrangement for renovating the target surface layer and, in addition, an arrangement for regulation of gas composition and pressure control have been incorporated in its design. Thus, the invention discussed herein has for its objects an arrangement for regulation of gas composition and pressure control;

improvement of the ion source design;

an arrangement for target renovation;

the use in the arrangement of such material as will be sufficient and necessary for the successful operation of the proposed ion accelerator.

Another object of this invention is a method for increasing the efficiency of operation of the proposed ion accelerator. The above objects of the invention will be understood from the following description and the explanation by means of the appended drawings.

SUMMARY OF THE INVENTION

Briefly, the essence of the invention amounts to the following:

The proposed ion accelerator comprises the following units enclosed in a single casing:

an ion source;

an arrangement for regulation of gas composition and pressure control;

the target unit with an arrangement for renovating the target surface.

The ion source unit contains the main and the additional anodes and three cathodes, one of which is a hot cathode.

The unit for regulation of gas composition and pressure control contains a getter evaporation pump and a getter storage for the gas ionized.

The target unit contains the target proper, which is fastened on a holder, and an anti-dynatron electrode. The means for target renovation contains a sorbent evaporator and a getter storage for the gas being sorbed by the target.

Another aspect of the invention is the choice and utilization of materials which are necessary for the realization of the invention. Thus the getter evaporation pump is constructed as a conductor of one of the sections of which is constructed as a strip of tantalum with a strip of titanium fastened on its plane;

the getter gas storage reservoir is constructed as a conductor of one of the sections of which is constructed as a strip of titanium, this strip being coated on both sides with a porous paste.

In accordance with another aspect of the invention to be described in the following composition, the percentage distribution of the ingredients and the preparation method of the above porous paste have been developed as well as the said method of increasing the operation efficiency of the proposed ion accelerator.

DESCRIPTION OF THE PREFERRED EMBODIMENT

Figure 1:
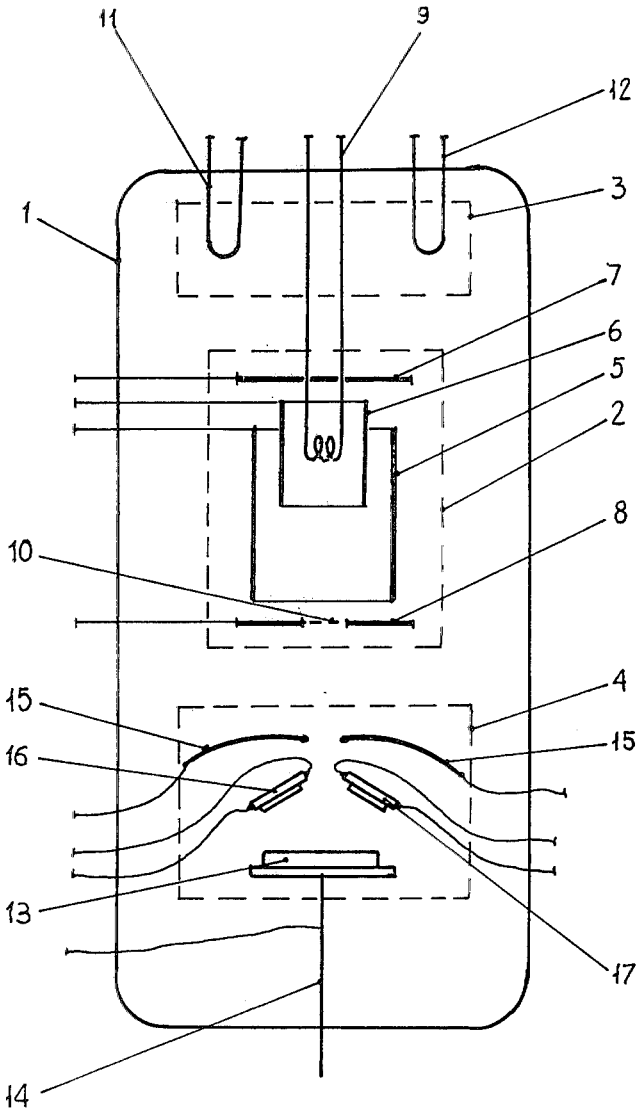
FIG. 1 shows the ion accelerator according to the preferred embodiment in a longitudinal cross-sectional view.

As shown in FIG. 1, in accordance with the preferred embodiment the ion accelerator contains the following units enclosed in casing 1:

unit 2 of the ion source;

arrangement 3 for regulation of gas composition and pressure control;

unit 4 of the target.

Units 2 and 4 as well as arrangement 3 are provided with their own controllable feed sources.

Figure 2:
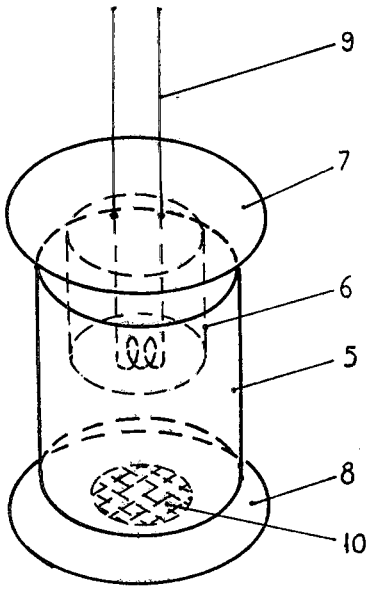
FIG. 2 illustrates the ion source unit in axonometric projection in accordance with the preferred embodiment of this invention.

Unit 2 of the ion source comprises main anode 5 and additional anode 6 placed in the cavity of the cylinder of the main anode 5, both the anodes constructed as hollow cylinders. Located at right angles to the axes of the cylinders of said anodes 5 and 6 are cathodes 7 and 8 shaped as discs. Hot cathode 9 constructed as a conductor with leads to its controllable feed source and with a spiral at the opposite end with respect to the leads passes through openings in cathode 7 and is located in the cavity of the cylinder of the additional anode 6. Cathode 8 at the disc center has an opening covered with net 10. Unit 2 of the ion source can be seen in detail in the axonometric projection shown in FIG. 2.

Arrangement 3 for regulation of gas composition and pressure control contains getter evaporation pump 11 and getter ionized gas storage 12, which are both located in casing 1 of the device between its side wall and ion source 2.

Figure 3:
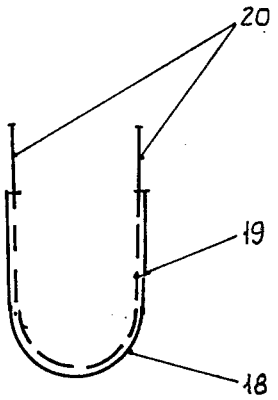
FIG. 3 is a longitudinal cross-sectional view of a getter evaporation pump to which the present invention is applied.
Figure 5:
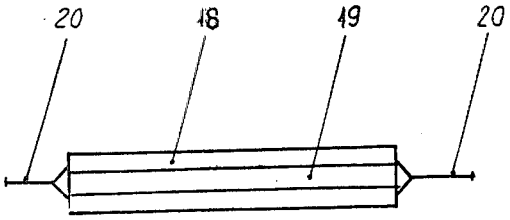
FIG. 5 is an enlarged perspective view of a portion of a getter evaporation pump of the present invention.

Getter evaporation pump 11 of arrangement 3 is constructed as a conductor one of the sections 18 of which is made of a tantalum strip. The inner plane of section 18 of the tantalum strip is overlaid with strip 19 made of titanium. Conductor section 18 with strip 19 of titanium is located in the ion accelerator casing, while cross-bars 20 are brought out to the outside and connected to their controllable feed source. The arrangement is shown in more detail as a cross-section of getter evaporation pump 11 in FIG. 3, its perspective view being shown in FIG. 5.

Figure 4:
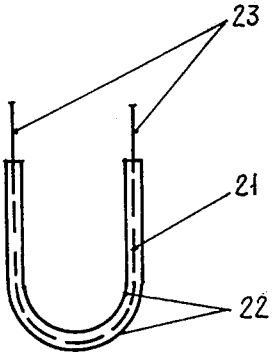
FIG. 4 is a longitudinal cross-sectional view of a getter gas storage to which the present invention is applied.

The getter storage 12 for the ionized gas of arrangement 3 is constructed as a conductor one of the sections 21 of which is made of a titanium strip coated on both sides with a layer of porous paste 22. The method of preparation and the composition of porous paste 22 is described below in an example of embodiment. Section 21 of the conductor with a coating of porous paste 22 is located in the ion accelerator casing, with cross-bars 23 being brought out to the outside and connected to their controllable feed source. The arrangement is shown in detail in FIG. 4 as a cross-sectional view of getter ionized-gas storage 12.

Target unit 4 contains target proper 13 fastened on holder 14 connected through a resistor with a high voltage source. Placed between target 13 and cathode 8 of ion source 2 is antidynatron electrode 15. Located above the target is a target renovation arrangement covered on top by the antidynatron electrode, the said arrangement containing sorbent evaporator 16 and getter storage 17 for the gas sorbed by the target. The construction of sorbent evaporator 16 is exactly the same as that of the getter evaporation pump shown in FIGS. 3 and 5, while the construction of getter storage 17 for the target-sorbed gas is exactly the same as that of getter storage 12 for the ionized gas.

Sorbent evaporator 16 and getter gas storage 17 are located above target 13 in the space between target 13 and antidynatron electrode 15 inside casing 1. Sorbent evaporator 16 is so located that its plane covered with the titanium strip forms a sharp angle with the plane of target 13. The magnitude of this angle may vary within 30°–60° depending on the parameters of sorbent evaporator 16. The leads of sorbent evaporator 16 and of getter gas storage 17 are connected each with its respective controllable feed source.

As has already been stated above, section 21 of getter gas storage 12 is coated on both sides with layers of porous paste 22. The following example will make clear the composition of the material from which porous paste 22 is prepared as well as the method of its preparation.

A powder mixture was prepared out of highly dispersed titanium and zirconium powders with particle size less than 10 microns and no less than 99.9% purity. The said titanium and zirconium powders were mixed, with an addition of organic binder, in the following proportion:

titanium powder: 0.2 g
zirconium powder: 0.1 g
organic binder: 0.1 g

The above binder was prepared in the following proportion:

amyl acetate: 0.025 g
ethyl acetate: 0.025 g
nitrocellulose: 0.05 g

The resulting mixture was blended in an agate mortar for three minutes and was then applied using a sterile brush of high quality hair (e.g. a ferret brush) to section 21 (titanium strip) of getter gas storage 12, section 21 having previously been roughened and thoroughly cleaned. The paste was applied to section 21 in amounts of from 0.02 g to 0.04 g per sq. cm. Getter gas storage 12 was then placed under an exhaust hood to be dried during one hour, following which the drying was continued in initial vacuum during 20 min. After this getter gas storage 12 was installed in the cavity of casing 1 of the ion accelerator and welded in it. Then the device was subjected to evacuation to a vacuum of $10^{-5}$ mm Hg. Subsequently, in order to remove the above-mentioned binder from the obtained powder mixture, the temperature of the device was slowly raised using an external box furnace. The temperature of the device was raised at a speed of about 1° C. per minute until a temperature of about +100° C. was reached. It was assumed that on reaching the above vacuum and temperature parameters the removal of the binder from the powder mixture was completed.

This was followed by the process of sintering the resulting mixture (paste). For this purpose, the external heating of the device was discontinued, and only getter gas storage 12 was slowly heated. During about 5 minutes the temperature of storage 12 was brought up to 900° C., care being taken that vacuum would not drop below $10^{-5}$ mm Hg. Incidentally, with greater gas release the heating time for storage 12 may be increased. The vacuum inside the device was then brought up to $10^{-6}$ mm Hg, and deuterium was admitted into it. Then the heating of storage 12 was decreased during 15 minutes. After the pressure inside the device stopped falling, it was evacuated in order to remove residual unabsorbed deuterium. Upon the vacuum inside the device reaching $10^{-6}$ mm Hg, the whole procedure was repeated twice, after which storage 12 was ready for operation in the proposed ion accelerator.

In accordance with the invention the proposed method of increasing the efficiency of ion accelerator operation will be better understood from the following example:

Prior to the ion accelerator being unsoldered from the vacuum installation, the ion source had been calibrated for subsequent use as a pressure gauge. Calibration data are given in Table 1.

TABLE 1

| | | | | | | |
|---|---|---|---|---|---|---|
| arc current | μA | 30 | 80 | 400 | 1000 | 2000 |
| pressure | mm Hg | $10^{-4}$ | $2.10^{-4}$ | $5.10^{-4}$ | $3.10^{-4}$ | $10^{-2}$ |

The unsoldering of the device was carried out at $4.10^{-7}$ mm Hg. 72 hours after it had been unsoldered, pressure in the device rose to $10^{-3}$ mm Hg. The increase in pressure was the result of gas evolution which occurred from the walls of the ion acclerator casing. In order to increase the effectiveness of ion accelerator operation the following steps were taken:

a. Problem No. 1: remove evolution gases, increase the vacuum.

Solution: getter evaporation pump feed was switched on—voltage 2.1 V, current 18 A, time—three cycles of 3 sec each. 100 sec after getter evaporation pump 11 was switched off the vacuum increased to $10^{-7}$ mm Hg (the arc current was 1 μA).

b. Problem No. 2: fill the cavity of the device with pure deuterium from getter ionized-gas storage 12.

Solution: the feed of ionized-gas storage 12 was switched on (the gas being deuterium in this experiment). The heating current was 0.3 A; voltage, 5.3 V. After 70 sec gas-storage 12 feed was switched off; 30 sec after the feed was switched off a stable pressure of $10^{-3}$ mm Hg set in (the arc current amounted to 600 μA).

c. Problem No. 3: check neutron yield.

Solution: high voltage was applied to the target with simultaneous application of all potentials to the ion source. The voltage across target 13 was 120 kV, the current, 120 μA. The neutron yield was $10^6$ neutron/sec.

d. Problem No. 4: repeat "washing" the cavity of the device with pure deuterium from getter ionized-gas storage 12.

Solution: operations described in a. and b. were repeated in succession. The neutron yield check (a repetition of the operation described in c.) showed that a yield of the order of $10^7$ neutrons per second and a fourth "washing" enabled the attainment of a neutron yield of $1.5 \cdot 10^8$ neutron/sec which satisfies the demands placed on the device.

After the ion accelerator had worked for about 200 hours, the neutron yield dropped to $7 \cdot 10^7$ under the same feed conditions. In order to restore the neutron yield to the necessary level, the following operations were performed which enabled the renewal of the target surface:

e. Problem No. 5: increase the vacuum, remove the evolved gases.

Solution: operation described in a.

f. Problem No. 6: obtain a new surface layer of target 13.

Solution: The feeds were switched on simultaneously of getter tritium storage 17 (voltage, 5 V, current, 0.25 A) for 30 sec, and of sorbent evaporator 16 (titanium, in this experiment) for the duration of four times×3 sec (voltage, 2 V; current, 15 A).

g. Problem No. 7: increase the vacuum, remove tritium from the gas phase.

Solution: The feed of getter evaporation pump 11 was switched on (in a similar way to the operation described in a.) 200 sec after getter tritium storage 17 was switched off. The 200 sec pause was introduced in order to make sure that the maximum amount of tritium is taken up by the new active layer of titanium on the surface of target 13.

h. Problem No. 8: "wash" the cavity of the device with deuterium for gas phase purification.

Solution: similar to operations described in a. and b.

i. Problem No. 9: check neutron yield.

Solution: Feed conditions the same as described in c., namely 120 kV across target 13 and 120 μA. Neutron yield amounted to $2 \cdot 10^8$ neutron/sec, which satisfies the demands placed on the device.

What is claimed as new and desired to be secured by Letters Patent of the United States is:

1. An ion accelerator comprising the following units enclosed in a common casing:

an ion source;

an arrangement of regulation of gas composition and pressure control in a space closed by the ion accelerator casing;

a target unit;

wherein the said ion source contains a main and an additional anode;

three cathodes one of which is a hot cathode;

wherein the said arrangement for regulation of gas composition and pressure control contains a getter evaporation pump and a getter storage for ionized gas; and, wherein the said target unit contains a target fastened on a holder;

an antidynatron electrode and an arrangement for target renovation.

2. An ion accelerator according to claim 1 wherein the main anode and the additional anode of the said ion source are constructed as cylinders, and wherein the cylinder of the additional anode is located in the cavity of the cylinder of the main anode.

3. An ion accelerator according to claim 1 wherein two of the said three cathodes of the said ion source are constructed as discs, the hot cathode being constructed as a filament, one of whose sections forms a spiral.

4. An ion accelerator according to claim 3 wherein one of the cathodes is located within the space of the ion accelerator casing, between the said system for vacuum control and the butt ends of the anode, the second cathode built with a net-covered opening in the centre, located under another butt end of the anodes, with its plane facing the target.

5. An ion accelerator according to claim 3, wherein the leads of the hot cathode are connected to a controllable feed source, and wherein the spiral-shaped section is located in the cavity of the cylinder of the additional anode.

6. An ion accelerator according to claim 1, wherein the getter evaporation pump and the getter gas storage of the said arrangement for regulation of gas composition and pressure control are located between the ion source and the end section of the cavity of the ion accelerator casing.

7. An ion accelerator according to claim 1 wherein the getter evaporation pump is executed in the form of a backing made of a refractory metal and a strip of titanium attached to said backing, said getter evaporation pump being located inside said accelerator casing and having leads brought outside for connection to an adjustable power supply source.

8. An ion accelerator according to claim 7 wherein the getter pump backing is made of tantalum strip having a cross-section larger than the cross-section of the titanium strip attached to said backing.

9. An ion accelerator according to claim 1 wherein the getter storage of ionized gas is executed in the form of a backing made of refractory metal covered with porous paste, said getter storage being located inside the accelerator casing and having leads brought outside for connection to an adjustable power supply source.

10. An ion accelerator according to claim 9 wherein said backing is made of titanium strip.

11. An ion accelerator according to claim 9, wherein the said porous paste is produced by the following method:

a titanium-zirconium powder mixture is prepared;

the obtained mixture is blended with an organic binder;

the mixture formed by blending the organic binder with the powder is applied over said refractory metal strip and is gradually heated in vacuum to 120° C.;

the said refractory metal strip with the mixture applied over it is sintered in vacuum at +800°-950° C.

12. An ion accelerator according to claim 11 wherein the mixture of titanium powder with zirconium powder is prepared in the following proportion:

titanium: 20%-80% zirconium: remainder

13. An ion accelerator according to claim 11 wherein the organic binder is prepared of a mixture of nitrocellulose, anyl acetate and ethyl acetate.

14. An ion accelerator according to claim 11 wherein the powder mixture of titanium and zirconium with the organic binder is prepared in the following proportion:

powder mixture: 60%-80% organic binder: remainder

15. An ion accelerator according to claim 1 wherein said arrangement for target renovation contains a sorbent evaporator and a getter storage for the target-sorbed gas which are located between the target and the antidynatron electrode.

16. An ion accelerator according to claim 15 wherein the sorbent evaporator is executed in the form of a backing of refractory metal located closely to the target surface outer (outside) edge, a strip of sorbent-metal being attached to said backing side facing said target, leads from said backing being brought outside for connection to an adjustable power supply source.

17. An ion accelerator according to claim 16 wherein said backing is made of a tantalum strip.

18. An ion accelerator according to claim 15 wherein the sorbent evaporator is positioned in such a manner that between the backing surface, whereto the strip of sorbent-metal is attached, and the target surface an acute angle is formed.

19. An ion accelerator according to claim 18 wherein the angle formed by the plane of said section of the sorbent evaporator and the target ranges from 30° to 60°.

20. An ion accelerator according to claim 15 wherein the getter storage of gas, which is sorbed by the target, is executed in the form of a backing made of a refractory metal covered with porous paste, said backing being located in the space between the antidynatron electrode and the target and being provided with leads brought outside for connection to an adjustable power supply source.

21. An ion accelerator according to claim 20 wherein said backing is made of a titanium strip.

22. An ion accelerator according to claim 20 wherein said porous paste is prepared and applied according to the following technique:

a titanium-zirconium powder mixture is prepared;

the obtained mixture is blended with an organic binder;

the mixture formed by blending the organic binder with the powder is applied over said refractory metal strip and is gradually heated in vacuum to 120° C.;

23. An ion accelerator according to claim 20 wherein said porous paste is prepared from the following materials and in following proportions:

titanium: 20%-80% zirconium: remainder.

24. A method for increasing the efficiency of the ion accelerator according to claim 1 wherein the steps follow in this sequence:

after the unsoldering of the ion accelerator from the vacuum installation the feed of the ion source is switched on;

the feed of the getter evaporation pump is switched on;

the feed of the getter evaporation pump is switched off after the current in the ion source ceases to flow;

the feed of the ionized working-gas storage is switched on, and the current increased unit the emergence of current in the ion source;

the target is energized with a high-voltage current.

25. A method for increasing the efficiency of the ion accelerator according to claim 1 wherein the renovation of the target surface is accomplished via the following sequence of steps:

the feed of the getter evaporation pump is switched on;

the feed of the getter evaporation pump is switched off;

the feed of the target-sorbed working-gas storage is switched on;

the feed of the sorbent evaporator and that of the target-sorbed gas storage are switched on simultaneously for a period of up to 10–20 seconds and then switched off;

the feed of the getter evaporation pump and that of the working-gas storage are switched on until working pressure sets in.

* * * * *